United States Patent [19]

Hungerford

[11] 4,048,477

[45] Sept. 13, 1977

[54] WEIGHT CONTROL CALCULATOR

[76] Inventor: Daniel Comstock Hungerford, P.O. Box 14306, North Palm Beach, Fla. 33408

[21] Appl. No.: 642,595

[22] Filed: Dec. 19, 1975

[51] Int. Cl.[2] ..... G06C 3/00

[52] U.S. Cl. ..... 235/88 R; 235/78 R

[58] Field of Search ..... 235/78 R, 88 R, 83, 235/61 R; 116/133; 35/74

[56] References Cited

U.S. PATENT DOCUMENTS

| | | | |
|---|---|---|---|
| 2,592,106 | 4/1952 | Askeli | 35/74 |
| 2,707,592 | 5/1955 | Rice | 235/78 R |
| 2,888,196 | 5/1959 | Welch et al. | 235/78 R |
| 3,572,584 | 3/1971 | Weaver | 235/88 R |

*Primary Examiner*—Robert K. Schaefer
*Assistant Examiner*—Vit W. Miska
*Attorney, Agent, or Firm*—Malin & Haley

[57] ABSTRACT

A hand-held weight control calculator which allows an individual to quickly and accurately determine the daily maximum food calories allowed for either maintaining body weight or for losing a particular number of pounds as a function of individual weight and activity level. The calculator includes a first indicia bearing disc having a plurality of radially arranged columns displaying daily calorie values disposed on its surface, with each column having a peripheral heading designating an individual weight range value and a registration arrow. A second smaller diameter disc is affixed to the center of the larger disc so that they rotate relative to each other, with the smaller disc including an observation window which is selectively registrable with a particular radial column disposed on the larger disc. The smaller disc includes a plurality of row headings displayed along one edge of the observation window which includes columnized indicia relative to the activity level of an individual such as "very active", "active" or "sedentary" with breakdowns in each activity level row for calories to maintain present weight or to lose a particular number of pounds per week. The device includes a third indicia bearing disc for determining the daily calories necessary for growth for individuals from infancy to adulthood.

4 Claims, 3 Drawing Figures

WEIGHT CONTROL CALCULATOR

BACKGROUND OF THE INVENTION

This invention relates generally to a compact, hand-held weight control calculator, and specifically to a hand actuated calculator which allows for an individual, with knowledge of his present weight, to determine the desirable number of maximum allowable calories per day which allow the individual to either maintain his present weight or to lose a particular number of pounds per week in accordance with a diet, as function of individual activity level, or to ascertain the number of calories for proper body growth.

In recent years medical science has come to recognize that excess weight in an individual above a predetermined normal or average results in a higher risk of certain related diseases such as heart attacks and strokes. Doctors have found that daily calorie intake is probably the most significant factor in controlling the weight of an individual. Although many books and articles have been published on the subject, most individuals are unable to easily and quickly determine what the proper amount of daily calorie intake is for achieving a desired body weight based as a function of daily activity level. Using the instant invention one can quickly determine the daily calorie intake maximum necessary to maintain present weight or to lose a specific amount of weight in a particular time period. The present invention also provides for daily calorie intake for proper growth during the adolescent growth stage of life. The device provides as a function of age a selectively registrable daily calorie intake determination for male or female adolescents for proper growth.

BRIEF DESCRIPTION OF THE INVENTION

A hand-held weight control calculator which provides an individual with maximum daily calorie values for a predetermined body weight control program. The device includes a first larger disc having displayed thereon a plurality of radially oriented pie-shaped columns, with each column having a peripherally disposed heading displaying indicia representative of weight ranges of a person. Disposed below each weight range heading are a plurality of smaller columns each containing a predetermined specific number of calories. A second smaller disc, rotatably attached to the larger disc, includes an observation window which is column sized to allow observation of a single column on the larger disc and includes a registration arrow for aligning the observation window of the smaller disc with a particular weight range column. Along the peripheral edge of the observation window indicia rows listing different human activity levels and particular calorie indicia headings for maintaining present weight or losing a particular number of pounds per week are displayed. These rows are selectively registrable with columns of calorie values displayed on the larger disc. The smaller disc at the top of the observation window also displays additional indicia for the particular size frame of the individual between "small", "medium" and "large" which are alignable with smaller individual columns of calorie values within the larger pie-shaped column on the larger disc. Thus to operate the device, the individual would register the smaller disc with a particular column in accodance with his weight. Once having done this, the individual may then, utilizing the indicia on the smaller disc, select what category of activity is most representative of the person. For example, an individual weighing between 200 and 210 pounds would manually rotate the smaller disc such that its indicia alignment arrow is aligned with a column on the larger disc having a heading from 200 to 210 pounds in the alignment arrow. The individual would then select from three circular rows next to the observation window on the smaller disc the particular row which is most characteristic of the individual's activity level. Once determining the broad activity row, the individual determines from the display in the observation window a particular maximum daily calorie intake value which will produce a desired weight for the individual. If an individual of a particular weight and activity level wished to lose 1 pound per week, he can quickly and accurately find the maximum allowable calories suited to his individual requirements, including frame size, activity, and present weight. The smaller disc may also include an indicia chart based on height and frame size which provides desirable weights for both men and women, age 25 and over.

On the opposite side of the device a growth calorie computer is disposed which provides a plurality of columns displayed on the larger disc, with column headings by age and a smaller disc with an observation window which includes indicia column information for both male and females by height and weight as a function of predetermined required growth calories, including an average annual desired weight increase and the annual percentage of weight increase. Selective registration of the smaller disc affixed thereto will allow an individual to determine the daily calories needed for male or female adolescent growth within a particular age range.

It is an object of this invention to provide a hand-held, compact calculator so that an individual may determine a particular number of daily calories allowed for correlation into a particular weight control program.

It is another object of this invention to provide a weight control calculator which allows a person to determine the particular number of calories per day to insure weight maintenance, weight growth or weight loss in accordance with a particular diet plan.

But still yet another object of this invention is to provide a hand actuated disc-shaped calculator which allows one to accurately but quickly ascertain daily allowable calories for maintaining a weight control program.

In accordance with these and other objects which will be apparent hereinafter, the instant invention will now be described with particular reference to the accompanying drawings.

PREFERRED EMBODIMENT OF THE INVENTION

Figure 1:
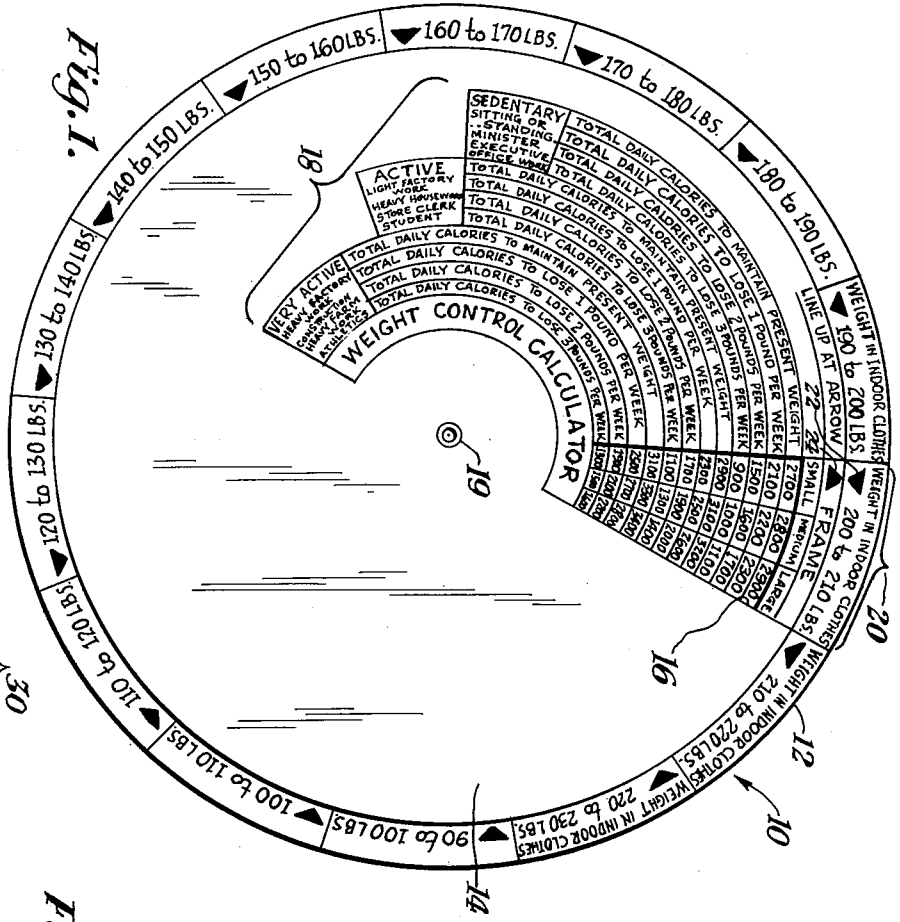
FIG. 1 shows a front elevational view of the instant invention.

Referring now to the drawings and specifically FIG. 1, the instant invention is shown generally at 10 comprised of a larger diameter disc 12 having coupled on one side a smaller disc 14 connected by grommet 19 to the center of both discs such that smaller disc 14 rotates relative to the larger disc 12. Disposed about the outer periphery of the larger disc 12 are a plurality of columnized headings such as heading 20 which displays indicia of an individual's weight in indoor clothes, and in the specific example shown in FIG. 1 is for 200 to 210 pounds. A registration arrow 22 is provided adjacent each particular column. The surface of the disc 12 includes a plurality of columns disposed around the entire disc surface 12, each column having smaller columns displaying calorie values as is described in greater detail below.

The smaller disc 14 includes a pie-shaped observation window 16 which is sized to expose one complete column of indicia displayed on the larger disc 12. The smaller disc 14 includes indicia along one side of the observation window 16 including a plurality of arcuate rows 18 having activity level row headings which include "sedentary", "active" or "very active". Each row includes a smaller breakdown beside the row heading of indicia describing a weight control program objective of calories to either maintain present weight or to lose a specific number of pounds as a function of the particular row heading for either "sedentary", "active", or "very active". The smaller disc 14 also includes a registration arrow 24 which is aligned with a particular arrow within a peripheral heading of the larger disc, such as arrow 22. Along the top of the observation window 16 are additional column headings displayed under "frame" which categorize weights for "small", "medium" or "large" frame individuals. Each large column of indicia (such as column 20) disposed on the larger disc 12 includes a plurality of narrower columns registered under the headings of "small", "medium" or "large" shown on the smaller disc 14. Each column 20 on the larger disc 12 is broken into a plurality of rows each having a specific number of calories disposed therein, with each row being selectively registrable with the columnized information 18 provided next to the observation window 16.

The purpose of the weight control calculator is to allow an individual to determine quickly and accurately the particular daily calorie maximum intake of foods to achieve or maintain a desired weight. To operate the device, the person first selects from the peripheral heading on the larger disc 12 a weight range which includes the individual's specific weight in indoor clothes. In the example shown for an individual who weighs from 200 to 210 pounds, the registration arrow 22 on the larger disc 12 is aligned with the smaller disc 14 registration arrow 24. The individual then determines what size frame the individual has, be it "small", "medium" or "large", which is displayed on the upper edge of the observation window 16 on disc 14. The individual then reviews the row headings 18 to determine the particular activity level of the individual be it "sedentary", "active" or "very active". For the sake of the example, an "active" person having a "medium" frame size who wishes to lose 1 pound per week would determine from the oservation window that 2500 calories per day maximum would achieve a 1 pound per week weight loss.

The disc 14 may include a supplemental chart which includes desirable weights for men and woman, age 25 and over, by height and frame size to allow an individual an objective goal for a particular weight.

Figure 2:
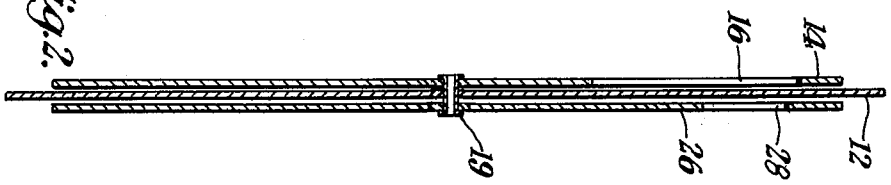
FIG. 2 shows a side elevational view in cross-section of the instant invention.

FIG. 2 shows the larger disc 12 connected to the smaller disc 14 on one side having an observation window 16 and on its opposite side a smaller disc 26 with an observation window 28, all discs connected through their centers by grommet 19 which allows for selective movement of disc 14 and 26 relative to the larger disc 12.

Figure 3:
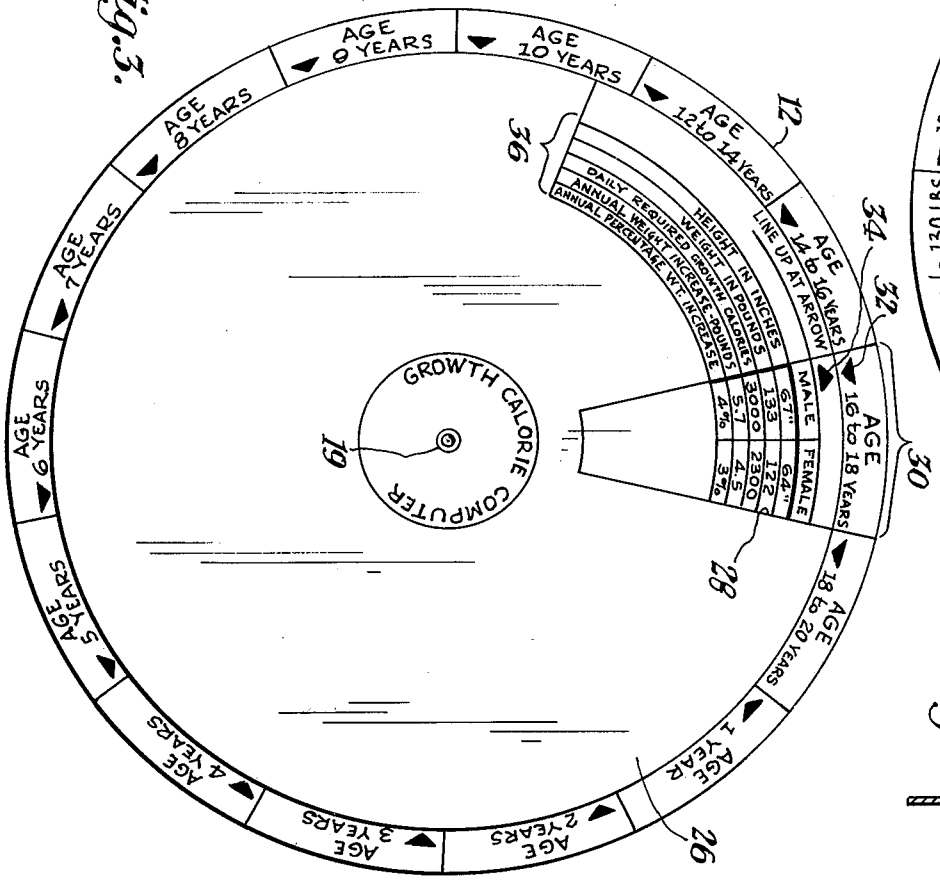
FIG. 3 shows a back elevational view of the instant invention.

Referring now to FIG. 3, the opposite side of the device in the preferred embodiment includes a growth calorie calculator which has a smaller disc 26 connected by grommet 19 to the larger disc 12 on the side opposite the weight control calculator. The growth calorie computer includes selectively registrable information showing age between particular years as a function of average height, weight, and daily calorie requirements to achieve a normal annual weight increase and annual percentage of weight increase based on predetermined norms. A plurality of radially disposed columns, such as column 30, includes a peripheral heading showing age between particular years and includes for each column a registration arrow 32 which functions with a registration arrow 34 disposed on the smaller disc 26. The smaller disc 26 includes an observation window 28 which exposes and displays a single column of information displayed on the larger disc 12. A pluality of row headings 36 are displayed on the left side of the observation window 28 and provide indicia relating height in inches, weight in pounds, daily required growth calories, annual weight increase in pounds and annual percentage weight increase. Above the observation window 28 is a columnized breakdown labeled "male" and "female". The column 30 displayed on the disc 12 includes column and row information which is selectively registrable with the rows 36 on the smaller disc 26 which allows for male and female norms of height in inches, weight in pounds, daily required calories, the annual weight increase and the percentage. In the example shown in FIG. 3, the smaller disc 26 has its registration arrow 34 aligned with the columnized information 30 showing an age from 16 to 18 years.

In the age column, from 16 to 18 years, the observation window displays the male and female height in inches of 67 inches and 64 inches respectively with the weight in pounds, 133 and 122 respectively, each showing a 3000 daily required growth calorie for the male and a 2300 daily required growth calories for the female. This will provide as a norm a 5.7 pound annual weight increase for a male and a 4.5 pound annual increase for the female. This also represents an annual percentage weight increase of 4 percent for the male and 3 percent for the female.

Thus, the growth calorie computer utilized in conjunction with the weight control calculator provides a hand-held relatively small device which when utilized by all members of the family to achieve a proper daily calorie intake which provides the number of calories which is easily and readily selected for proper weight control.

The instant invention has been shown and described herein in what is considered to be the most practical and perferred embodiment. It is recognized, however, that departures may be made therefrom within the scope of the invention and that obvious modifications will occur to a person skilled in the art.

What I claim is:

1. A hand-held weight control calculator comprising:

a first display surface having a peripheral edge, said first surface including a plurality of radially disposed indicia columns, each of said columns having an indicia weight range heading disposed near said first surface peripheral edge and a plurality of indicia rows within each column displaying daily intake calorie values as a function of weight range, frame size and activity level; and a second display surface having an observation aperture sized to display a single indicia column on said first display surface, said second display surface including rows of indicia displaying individual activity levels along one side of said observation aperture; and first registration indicia for selectively registering said second display surface observation aperture with a particular column on said first display surface.

2. A weight control calculator, as in claim 1, wherein; said first display surface is a larger disc and said second display surface is a smaller disc.

3. A weight control calculator, as in claim 2, including;

a third display surface having a peripheral edge connected to said first display surface on the side opposite said second display surface, said third display surface including an observation aperture, said first display surface including age indicia column headings and columnized indicia of calories for daily growth as a function of age and second registration indicia for aligning said third display surface and said first display surface to provide daily calorie intake for normal growth rates as a function of age.

4. A hand-held calculator for determining the number of daily calories for proper growth as a function of individual age comprising:

a first indicia bearing disc having a peripheral edge, said first disc including a plurality of indicia columns displaying predetermined daily calorie intake requirement values, each of said indicia columns having an indicia heading displaying an individual age range value disposed near the peripheral edge of said first disc; and second indicia bearing disc moveably coupled to said first disc, said second disc including an observation window sized to expose a particular column of caloric value indicia on said first disc, said second disc having indicia disposed next to said observation window for ascertaining bodily growth information correlated to indicia on said first disc; and registration indicia disposed on said first disc and said second disc for selectively registering said first disc and said second disc to determine daily calories required for a particular growth as a function of age.

* * * * *